US005213158A

United States Patent [19]

Bailey et al.

[11] Patent Number: 5,213,158

[45] Date of Patent: May 25, 1993

[54] DUAL ROTATING STRIPPER RUBBER DRILLING HEAD

[75] Inventors: Thomas F. Bailey; John E. Campbell, both of Houston, Tex.

[73] Assignee: MASX Entergy Services Group, Inc., Houston, Tex.

[21] Appl. No.: 811,553

[22] Filed: Dec. 20, 1991

[51] Int. Cl.[5] ..... E21B 33/068

[52] U.S. Cl. ..... 166/82; 166/84; 175/195

[58] Field of Search ..... 166/82, 84; 175/195

[56] References Cited

U.S. PATENT DOCUMENTS

| | | | |
|---|---|---|---|
| 2,222,082 | 11/1940 | Leman et al. | 175/195 |
| 2,846,247 | 11/1953 | Davis | 166/84 |
| 3,400,938 | 9/1968 | Williams . | |
| 3,934,887 | 1/1976 | Biffle . | |
| 3,965,987 | 6/1976 | Biffle . | |
| 4,143,880 | 3/1979 | Bunting et al. | 166/82 |
| 4,154,448 | 5/1979 | Biffle . | |
| 4,293,047 | 10/1981 | Young | 175/195 |
| 4,363,357 | 12/1982 | Hunter . | |
| 4,367,795 | 1/1983 | Biffle . | |
| 4,423,775 | 1/1984 | Wilson . | |
| 4,423,776 | 1/1984 | Wagoner et al. | 175/195 |
| 4,441,551 | 4/1984 | Biffle . | |
| 4,500,094 | 2/1985 | Biffle . | |
| 4,531,580 | 7/1985 | Jones | 166/84 |
| 4,955,436 | 9/1990 | Johnson . | |

*Primary Examiner*—Thuy M. Bui
*Assistant Examiner*—Frank S. Tsay
*Attorney, Agent, or Firm*—Edgar A. Zarins; Malcolm L. Sutherland

[57] ABSTRACT

A drilling head with dual rotating stripper rubbers designed for high pressure drilling operations ensuring sealing under the extreme conditions of high flow or high pressure wells such as horizontal drilling. The dual stripper rubbers seal on the same diameter yet are manufactured of different materials for different sealing functions. The lower stripper rubber is manufactured from a more rigid, abrasive resistant material to divert the flow from the well. The upper stripper rubber is manufactured of a softer sealing material that will closely conform to the outer diameter of the drill string thereby preventing the flow of fluids through the drilling head.

4 Claims, 2 Drawing Sheets

DUAL ROTATING STRIPPER RUBBER DRILLING HEAD

BACKGROUND OF THE INVENTION

I. Field of the Invention

This invention relates to drilling heads for oil and gas wells and, in particular, to a drilling head which employs dual rotating stripper rubbers to seal against the well string preventing the flow of fluids upwardly through the drilling head.

II. Description of the Prior Art

Early drilling heads employed a single stripper rubber to divert the flow of drilling fluid away from the rig floor. The stripper rubber was fixedly mounted within the drilling head and the drill string rotated and moved longitudinally through the stripper rubber as it is attempted to seal against the string. It was determined that the action of the drill string caused considerable wear on the stripper rubber requiring frequent replacement. To reduce the abrasive wear, the stripper rubber was rotated with the drill string to maintain sealing contact. However, a drill string typically includes various diameter sections. For example, the drill collars joining sections of drill string have a greater diameter than the drill pipe itself. Thus, the stripper rubber was sized to maintain sealing contact with the drill pipe or the smallest diameter component which travelled through the drilling head. Because of the different diameters of the drill string, the stripper rubber needed to be rigid enough to withstand the pressures of the drilling fluid yet resilient enough to maintain a seal on the drill collars as they passed through the drilling head and thereafter return to the original configuration to seal against the smaller diameter drill pipe. The operating cycle of the drilling head was directly proportional to number of drill collars which passed through the single stripper rubber since the stripper would not return to its original sealing diameter.

In an attempt to maintain sealing contact with both the smaller drill pipe and the drill collars, dual stripper rubber drilling heads included stripper rubbers with different inner diameters designed to seal against the drill collars and drill pipe. Early versions only rotated one of the stripper rubbers since the lower stripper was fixedly mounted within the drilling head. More recently, dual rotating stripper rubbers, each with a different inner diameter, have been employed in drilling heads by mounting the lower stripper rubber to a drive ring extension which is connected to the drive bushing at the upper end of the drilling head. Despite the advantages of the prior known dual stripper rubber drilling heads, only one of the stripper rubbers is typically in sealing contact with the drill string. Accordingly, the dual stripper rubbers do not provide additional sealing against the flow of drilling fluids.

SUMMARY OF THE PRESENT INVENTION

The present invention overcomes the disadvantages of the prior known drilling heads by providing dual rotating stripper rubbers which have similar inner diameters to provide additional sealing in high pressure environments.

The drilling head of the present invention includes a lower inlet flange for mounting to the well, a side outlet flange through which the drilling fluids are diverted for disposal/recycling, a main body which houses dual rotating stripper rubbers and bearing assemblies, and a drive assembly mounted at the upper end of the main housing for engagement with the kelly drive of the drill string. Each of the stripper rubbers are rotatively connected to the drive assembly at the upper end of the drilling head. As a result, as the drive bushing rotates within the drilling head in conjunction with the kelly and drill string, the stripper rubbers will also rotate thereby maintaining sealing contact with the drill string to divert the drilling fluid from the well to the outlet flange.

The dual rotating stripper rubbers have substantially identical inner diameters to simultaneously seal against the drill string, specifically the smaller diameter drill pipe. However, the stripper rubbers are each manufactured of different materials to perform different functions within the drill head. Accordingly, the dual sealing action provides improved operation in high flow or pressure wells such as in horizontal drilling or geothermal wells. In a preferred embodiment, the lower stripper rubber can be manufactured from a material which is abrasive resistant to divert a majority of the flow while the upper stripper rubber can be manufactured from a more resilient material better suited for sealing pressure than for abrasion and erosion.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
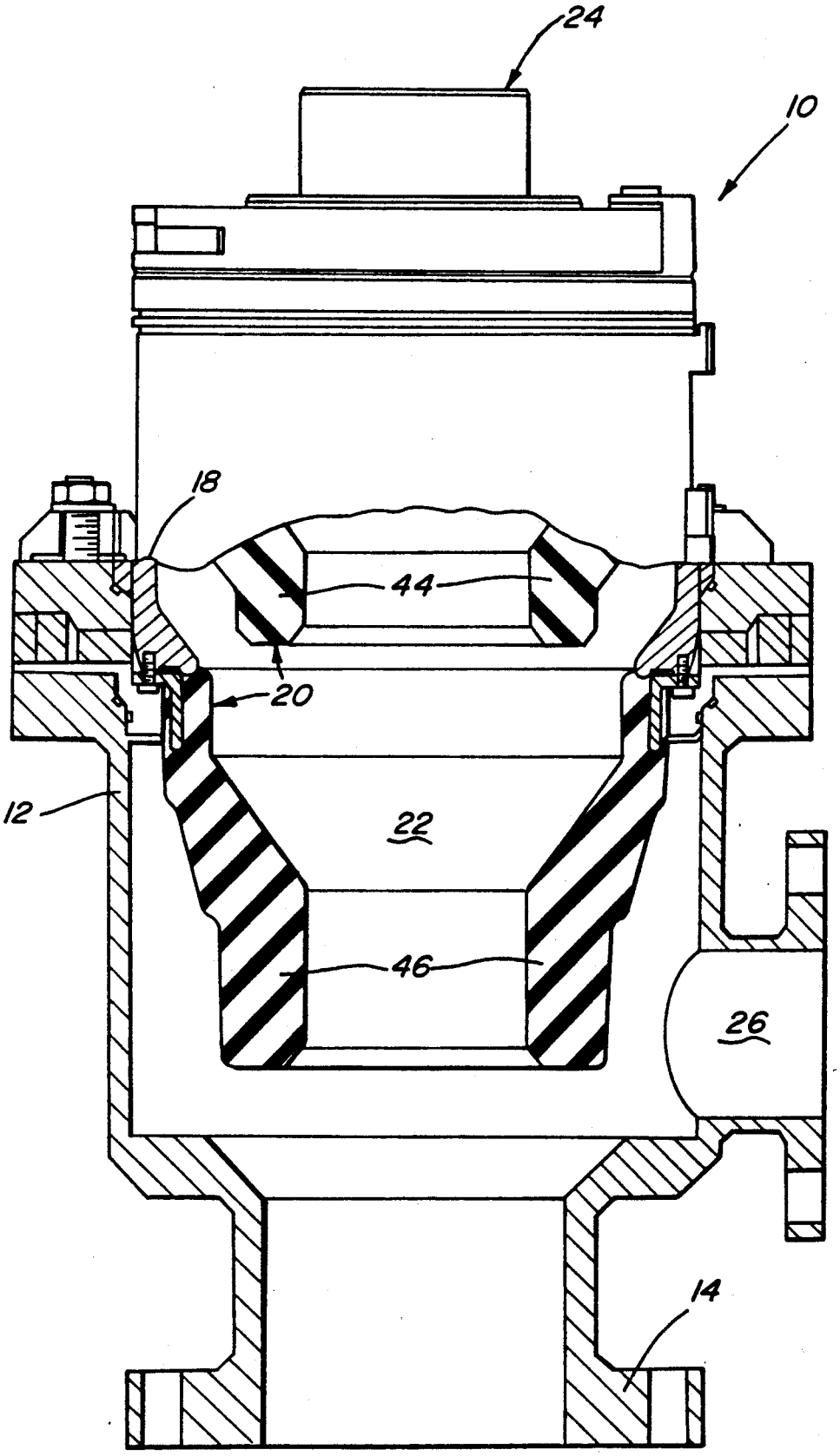
FIG. 1 is a partial cross-sectional view of a drilling head with dual rotating stripper rubbers embodying the present invention.
Figure 2:
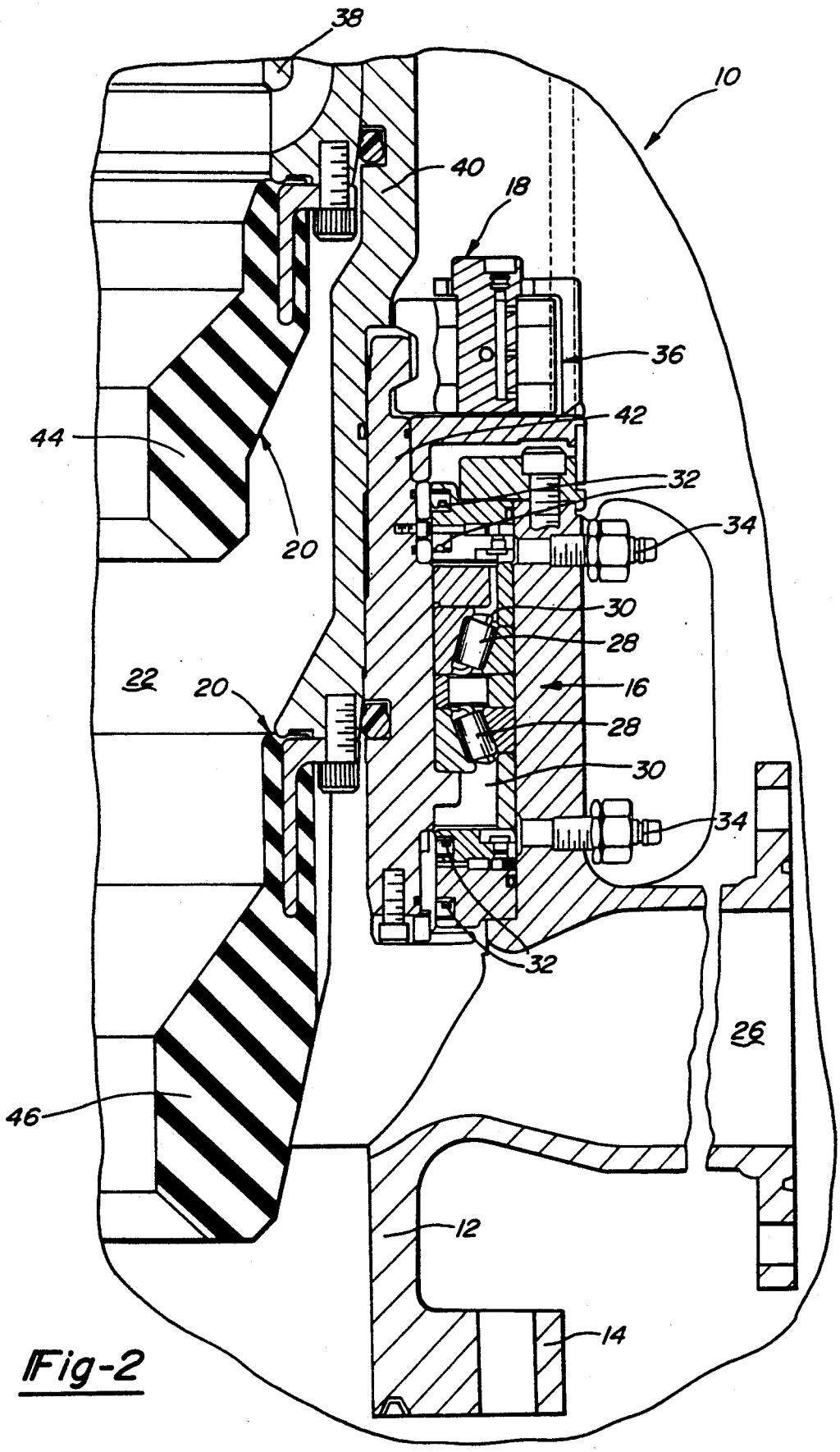
FIG. 2 is an enlarged cross-sectional view of the dual rotating stripper rubbers of the present invention.

Referring to FIGS. 1 and 2, there is shown a drilling head 10 incorporating the present invention for accepting a drill string (not shown) while diverting drilling fluid from the rig floor. The drilling head 10 generally includes a housing 12 with a bottom flange 14 for securing the drilling head 10 on top of the well. The housing 12 may be of a multiple piece construction to permit access to the interior of the drilling head 10 for repair/replacement of the bearing assemblies 16, drive assembly 18 and either of the stripper rubbers 20 as will be subsequently described herein. The housing 12 includes an axial passageway 22 through which the drill string extends. A kelly drive 24 at the top of the drilling head 10 cooperates with the kelly of the drill string as is well known. The housing 12 preferably includes a side outlet passageway 26 through which drilling fluids from the well are diverted for processing.

Referring more specifically now to FIG. 2, the drilling head 10 is dependent upon the bearing assembly 10, the drive assembly 16 and the stripper rubbers 20 for proper operation to accept the drill string while sealing against the drill string to prevent drilling fluids from flowing upwardly through the drilling head 10. The bearing assembly 16 ensures smooth rotation of the drill string and drive assembly 18 within the drilling head 10. The bearing assembly 16 may include roller bearings 28 mounted within a lubricant passageway 30 for maintaining lubrication of the entire bearing assembly 16. High pressure seals 32 at the ends of the passageway 30 prevent debris from fouling the lubricant while maintaining a closed system. Lubrication ports 34 may be included to allow addition of lubricant.

The bearing assembly 16 facilitates smooth rotation of the drive assembly 18 in association with the kelly and drill string. Clamp assemblies 36 maintain the integrity of the drive assembly 18 but allow simple access for repair/replacement. In a preferred embodiment of the present invention, the drive assembly 18 includes a drive bushing 38 and a drive ring extension 40 and a drive ring 42 associated with the bearing assembly 16. These components will rotate within the drilling head 10 in conjunction with the drill string and, in particular, the stripper rubbers 20 as will be subsequently described.

Although dual rotating stripper rubbers 20 for drilling heads 10 are known, the prior art drilling heads 10 utilized strippers having different inner diameters so that at least one stripper was always in sealing contact with the drill string. In the present invention, the dual stripper rubbers 20 include upper stripper rubber 44 and a lower stripper rubber 46 which have substantially identical inner diameters which maintain contact with the drill string. The upper stripper rubber 44 is mounted to the drive bushing 38 while the lower stripper rubber 46 is mounted to the drive ring extension 40 to position the second stripper 46 axially below the first stripper rubber 44. Both stripper rubbers 44 and 46 rotate with the drill string and are sized to maintain sealing contact with the smallest diameter of the string, typically the drill pipe. As a result, the stripper rubbers 44 and 46 will expand as collars and joints pass therethrough and thereafter contract to seal against the drill pipe.

The upper and lower stripper rubbers 44,46 are preferably manufactured of different material to perform different functions within the drilling head 10 and thereby ensure that drilling fluids and the like from the well are diverted to the side outlet port 26 and prevented from flowing up through the drilling head 10 to the rig floor. The lower stripper rubber 46 is preferably formed of an abrasive resistant material to divert the drilling fluid from the axial passageway 22 to the side outlet 26. This material is preferably highly resistant to the abrasive and erosive action of the drilling fluids and as such has a more rigid form. Examples of such stiffer abrasive resistant materials include urethane, nitrile and butyl. In contrast, the upper stripper rubber 44 is preferably formed of a softer, sealingly resilient material which maintains and retains sealing pressure on the drill string as it travels therethrough. Thus, the lower stripper rubber 46 will divert a bulk of the fluids from the well particularly the heavier drilling fluids while the upper stripper rubber 44 ensures sealing contact to prevent any remaining fluids, particularly gases, from travelling through the drilling head 10. Examples of sealingly resilient materials for use in the upper stripper rubber include natural rubber, HSN and butyl. In the dual rotating stripper rubber configuration, the lower stripper rubber acts as the primary seal preventing flow of drilling fluids through the drilling head. The upper stripper rubber blocks any bypass flow while acting as a secondary seal as the lower seal wears or fails under pressure. The majority of wear from the rig operations is directed to the lower stripper rubber while the upper stripper rubber acts as a backup. In addition, the dual stripper rubbers simplify tripping in and out of the well. While tripping in and out of the well, the upper stripper rubber is removed leaving at least the lower stripper rubber to protect against fluid flow from the well. Thus, the present invention provides dual rotating stripper rubbers which seal on the same diameter yet which perform different functions to ensure sealing diversion of drilling fluids.

The foregoing detailed description has been given for clearness of understanding only and no unnecessary limitations should be understood therefrom as some modifications will be obvious to those skilled in the art without departing from the scope and spirit of the appended claims.

What is claimed is:

1. In a drilling head for a wellbore through which a tool string of varying outside diameter is run, the drilling head sealing against fluid flow past the tool string to divert such fluid through a side outlet port, said drilling head including a housing having an axial passageway through which the tool string is run and a bearing assembly to facilitate rotation of the tool string within the axial passageway, the improved drilling head comprising:

first and second stripper rubbers rotatably mounted within the drilling head housing in sealing contact with the tool string, said stripper rubbers having substantially identical inner diameters through which the tool string extends, said first stripper rubber formed of an abrasive resistant material to divert fluid flow from the axial passageway of the housing to the side outlet port and said second stripper rubber formed on a sealingly resilient material which maintains sealing contact with the tool string extending therethrough preventing fluid flow past said tool string;

said first stripper rubber being corrected to clamping means associated with the bearing assembly through a first drive ring such that said first stripper rubber rotates with the tool string; and said second stripper rubber is rotatably connected to said clamping means associated with the bearing assembly through a second drive ring, said first and second drive rings coaxially mounted within the housing whereby said first stripper rubber is positioned axially below said second stripper rubber in sealing contact with the tool string.

2. A drilling head connected to the upper end of a wellbore, the drilling head including a housing having an axial passageway through which a rotating tool string can be received and a lateral outlet port in communication with the axial passageway, said drilling head comprising:

first and second stripper rubbers rotatably mounted within the drilling head housing in sealing contact with the tool string to divert drilling fluids from the well bore to the outlet port, said stripper rubbers having substantially identical inner diameters to maintain contact with the tool string, said first stripper rubber mounted axially below said second stripper rubber, said first stripper rubber formed of an abrasive resistant material to divert fluid flow from the axial passageway to the outlet port and said second stripper rubber formed of a sealingly resilient material which maintains sealing contact with different diameter portions of the drill string extending therethrough; and first and second drive rings concentrically mounted within said housing and connected to clamping means associated with a bearing assembly of said housing, said first stripper rubber attached to said first drive ring axially below said second stripper rubber attached to said second drive ring such that said first and second stripper rubbers rotate with the tool string.

3. The drilling head as defined in claim 2 wherein said first stripper rubber is formed of a semi-rigid abrasive material to divert the high pressure fluid flow from the axial passageway of the drilling head to the outlet port, said abrasive resistant material selected from the group consisting of urethane, nitrile and butyl.

4. The drilling head as defined in claim 2 wherein said second stripper rubber is formed of a sealingly resilient material to maintain sealing contact with the tool string moving through the drilling head, said sealingly resilient material selected from the group consisting of natural, rubber, HSN and butyl.

* * * * *